US010414538B2

(12) United States Patent
Brundage et al.

(10) Patent No.: US 10,414,538 B2
(45) Date of Patent: Sep. 17, 2019

(54) CARTON AND BLANK THEREFOR

(71) Applicant: WestRock Shared Services, LLC, Norcross, GA (US)

(72) Inventors: David J. Brundage, Salinas, CA (US); Chad Rebmann, Maple Valley, CA (US); Jory B. Mack, Village of Lakewood, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 15/800,177

(22) Filed: Nov. 1, 2017

(65) Prior Publication Data

US 2018/0127141 A1 May 10, 2018

Related U.S. Application Data

(60) Provisional application No. 62/417,678, filed on Nov. 4, 2016.

(51) Int. Cl.

| | |
|---|---|
| ***B65D 5/42*** | (2006.01) |
| ***B65D 5/00*** | (2006.01) |
| ***B65D 5/16*** | (2006.01) |
| *B31B 50/83* | (2017.01) |

(52) U.S. Cl.

CPC ..... *B65D 5/4204* (2013.01); *B65D 5/001* (2013.01); *B65D 5/16* (2013.01); *B65D 5/4208* (2013.01); *B31B 50/83* (2017.08)

(58) Field of Classification Search

CPC ..... B65D 5/4204; B65D 5/001; B65D 5/16; B65D 5/4208

USPC ..... 229/162.7, 162.1, 162.6, 160, 109, 915, 229/916, 918, 919; 206/775, 776; 220/662; 493/905

See application file for complete search history.

(56) References Cited

U.S. PATENT DOCUMENTS

| | | | | |
|---|---|---|---|---|
| 4,607,750 | A * | 8/1986 | Valenti | B65D 5/5026 206/427 |
| 5,139,196 | A * | 8/1992 | Fry | B65D 5/10 229/109 |
| 2007/0228132 | A1* | 10/2007 | Philips | B65D 5/001 229/242 |
| 2008/0245849 | A1* | 10/2008 | Mathieu | B65D 5/16 229/117.17 |

* cited by examiner

*Primary Examiner* — Christopher R Demeree

(74) *Attorney, Agent, or Firm* — WestRock IP Legal

(57) ABSTRACT

A carton includes a top wall, a bottom wall, and a front wall. A display window is formed through at least a portion of the front wall and through at least a portion of the top wall. The display window is formed by an inwardly-folding window panel. The inwardly-folding window panel forms at least a portion of the bottom wall. The top wall includes first and second top major flaps that partially overlap to form an outwardly-projecting overlapping portion of the top wall. The bottom wall includes first and second bottom major flaps that define a recess therebetween. The overlapping portion of a first such carton is configured to be received within the recess of a second such carton when the second such carton is stacked on top of the first such carton.

14 Claims, 9 Drawing Sheets

CARTON AND BLANK THEREFOR

REFERENCE TO RELATED APPLICATION

This application claims the benefit of priority under 35 U.S.C. § 119(e) of U.S. provisional application Ser. No. 62/417,678 filed on Nov. 4, 2016, which is hereby incorporated by reference in its entirety.

BACKGROUND

The field of the invention relates generally to a carton and, more particularly, to a carton having an in-folded display window panel that forms at least part of the carton's bottom wall.

It is known in the art to form a variety of containers from foldable blanks fabricated from cardboard, paperboard, corrugated paper and the like. In certain applications it can be desirable to provide a carton having a display window that allows a prospective purchaser to inspect the product or products packaged in the carton. In can also be desirable to provide a carton having substantial stacking strength to facilitate the stacking of multiple cartons one on top of the other. It can also be desirable to provide a carton that can be readily and securely stacked such that stacked cartons are generally aligned or centered with one another. It can also be desirable to provide a carton having substantial lateral strength such that one or more cartons can be gripped by machine clamp bars during stacking, palletizing, or other moving of the cartons. It can also be desirable to provide a carton formed from a blank using a minimal amount of blank material and having a minimal overall footprint.

Accordingly, it is an object of the present invention to provide a carton and blank therefor that provide one or more of the above-described features.

SUMMARY OF INVENTION

According to a first aspect of the invention, there is provided a carton including a top wall, a bottom wall, and a front wall. A display window is formed through at least a portion of the front wall and through at least a portion of the top wall. The display window is formed by an inwardly-folding window panel that also forms at least a portion of the bottom wall. The top wall comprises first and second top major flaps that partially overlap to form an outwardly-projecting overlapping portion of the top wall. The bottom wall includes first and second bottom major flaps that define a recess therebetween. The overlapping portion of a first such carton is configured to be received within the recess of a second such carton when the second such carton is stacked on top of the first such carton.

Optionally, the overlapping portion and the recess are operably configured such that the second such carton is substantially centered with respect to the first such carton when the overlapping portion of the first such carton is received within the recess of the second such carton.

Optionally, the carton further comprises a rear wall, first and second side walls, and first, second, third, and fourth corner walls.

Optionally, the first and second top major flaps and the first and second bottom major flaps each comprise first and second angled edges, each of the first and second angled edges abutting an interior surface of an adjoining one of the first, second, third, or fourth corner walls.

Optionally, the top wall further includes first and second minor top flaps, the first top minor flap defining a first corner notch and the second top minor flap defining a second corner notch. The second top major flap includes first and second corner portions defined by an edge of the display window. The first corner portion is substantially aligned with and overlaps the first corner notch and the second corner portion is substantially aligned with and overlaps the second corner notch.

Optionally, the inwardly-folding window panel includes a first bridge panel hingedly connected along a lower edge of the first bridge panel to the front wall, a second bridge panel hingedly connected to the first bridge panel, and a floor panel hingedly connected to the second bridge panel, the floor panel forming the at least portion of the bottom wall.

Optionally, the second bridge panel includes at least one tab, the second bottom major flap defines at least one aperture, and the at least one tab is received within the at least one aperture.

According to a second aspect of the invention, a blank for forming a carton is provided. The blank includes a front panel configured to form a front wall in a set-up carton, first and second side wall panels configured to form respective first and second side walls in the set-up carton, a rear panel configured to form a rear wall in the set-up carton, first and second top major flaps configured to form at least part of a top wall in the set-up carton, the second top major flap being hingedly connected to the front panel along a first fold line, and a generally-rectangular window panel struck from a portion of the front panel and a portion of the second top major flap so as to interrupt the first fold line. The window panel includes a floor panel configured to form at least a portion of a bottom wall in the set-up carton. The window panel is hingedly connected to a lower portion of the front panel along a second fold line. The window panel is folded into an interior of the set-up carton to form a display window extending through at least a portion of the front wall and through at least a portion of the top wall. The first and second top major flaps are configured to overlap in the set-up carton to form an outwardly-projecting overlapping portion of the top wall. The bottom wall includes first and second bottom major flaps that define a recess therebetween. The overlapping portion of a first such set-up carton is configured to be received within the recess of a second such set-up carton when the second such set-up carton is stacked on top of the first such set-up carton.

Optionally, the overlapping portion and the recess are operably configured such that the second such set-up carton is configured to be substantially centered with respect to the first such set-up carton when the overlapping portion of the first such set-up carton is received within the recess of the second such set-up carton.

Optionally, the blank further includes first, second, third, and fourth corner panels configured to form respective first, second, third, and fourth corner walls in the set-up carton.

Optionally, the first and second top major flaps and the first and second bottom major flaps each include first and second angled edges, each of the first and second angled edges being configured to abut an interior surface of an adjoining one of the first, second, third, or fourth corner walls in the set-up carton.

Optionally, the blank further includes first and second minor top flaps, the first top minor flap defining a first corner notch and the second top minor flap defining a second corner notch. The second top major flap includes first and second corner portions defined by an edge of the display window in the set-up carton. The first corner portion is substantially aligned with and overlaps the first corner notch and the second corner portion is substantially aligned with and overlaps the second corner notch in the set-up carton.

Optionally, the window panel includes a first bridge panel hingedly connected to the lower portion of the front panel along the second fold line, a second bridge panel hingedly connected to the first bridge panel, and a floor panel hingedly connected to the second bridge panel, the floor panel forming the at least portion of the bottom wall in the set-up carton.

Optionally, the second bridge panel includes at least one tab, the second bottom major flap defines at least one aperture, and the at least one tab is configured to be received within the at least one aperture in the set-up carton.

Within the scope of this application it is envisaged that the various aspects, embodiments, examples, features and alternatives set out in the preceding paragraphs, in the claims and in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION

Detailed description of specific embodiments of blanks and cartons are disclosed herein. It will be understood that the disclosed embodiments are merely examples of the way in which certain aspects of the invention can be implemented, and do not represent an exhaustive list of all the ways the invention may be embodied. As used herein, the word "exemplary" is used expansively to refer to embodiments that serve as illustrations, specimens, models, or patterns. Indeed, it will be understood that the cartons and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

The present disclosure describes a carton that is constructed from a blank of sheet material. In the example embodiments, the carton is at least partially formed using a machine. For example, the blank can be wrapped about a mandrel to form a knocked-down flat (KDF) carton, and the final construction of the carton can be performed by hand and/or by another machine. In one embodiment, the carton is fabricated from a paperboard material. The carton, however, may be fabricated using any suitable material, and therefore is not limited to a specific type of material. In alternative embodiments, the carton is fabricated using cardboard, plastic, fiberboard, paperboard, foamboard, corrugated paper, and/or any suitable material known to those skilled in the art and guided by the teachings herein provided.

Figure 1:
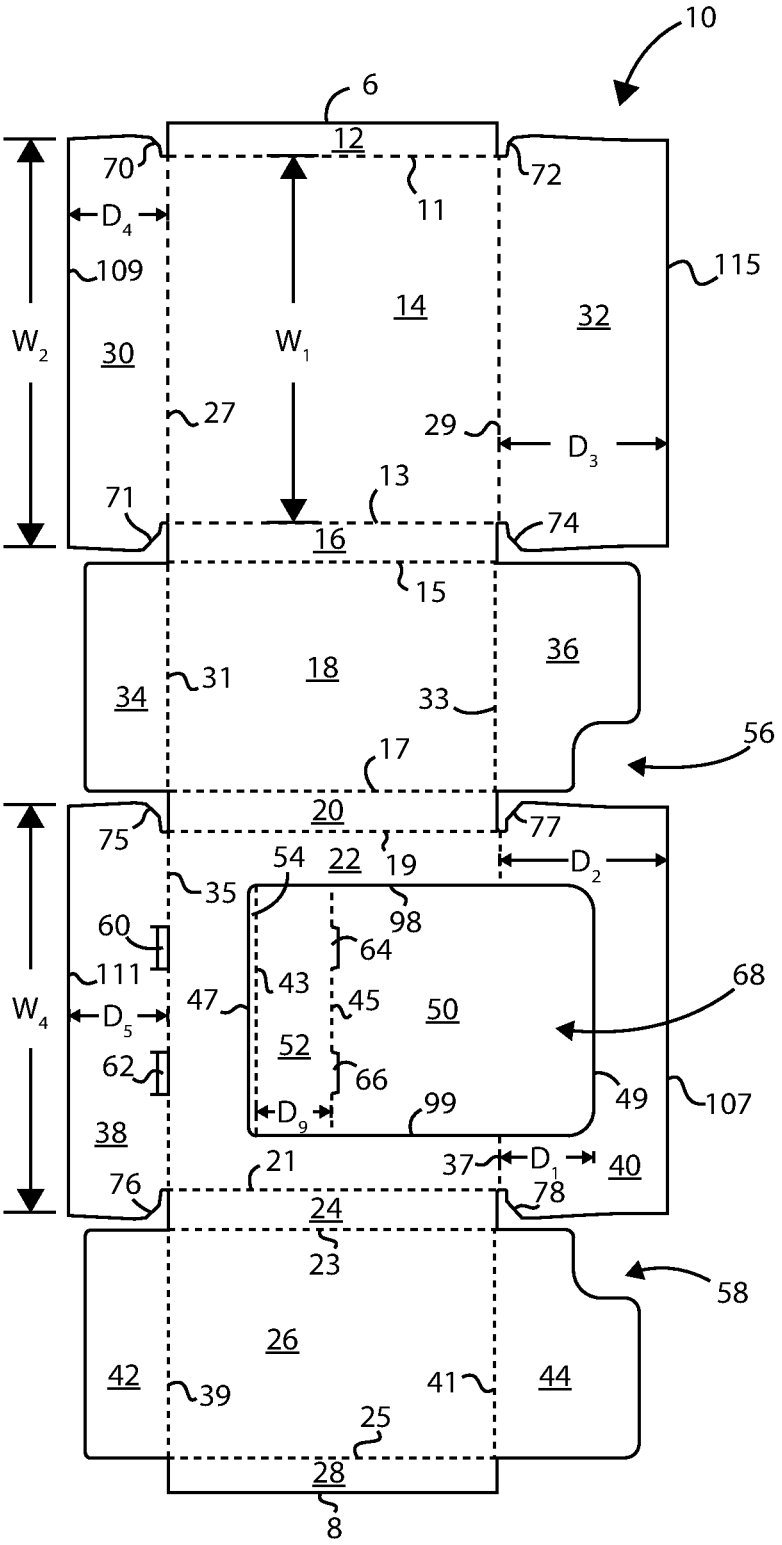
FIG. 1 is a top plan view of an exemplary blank of sheet material according to a first embodiment of the invention.
Figure 2:
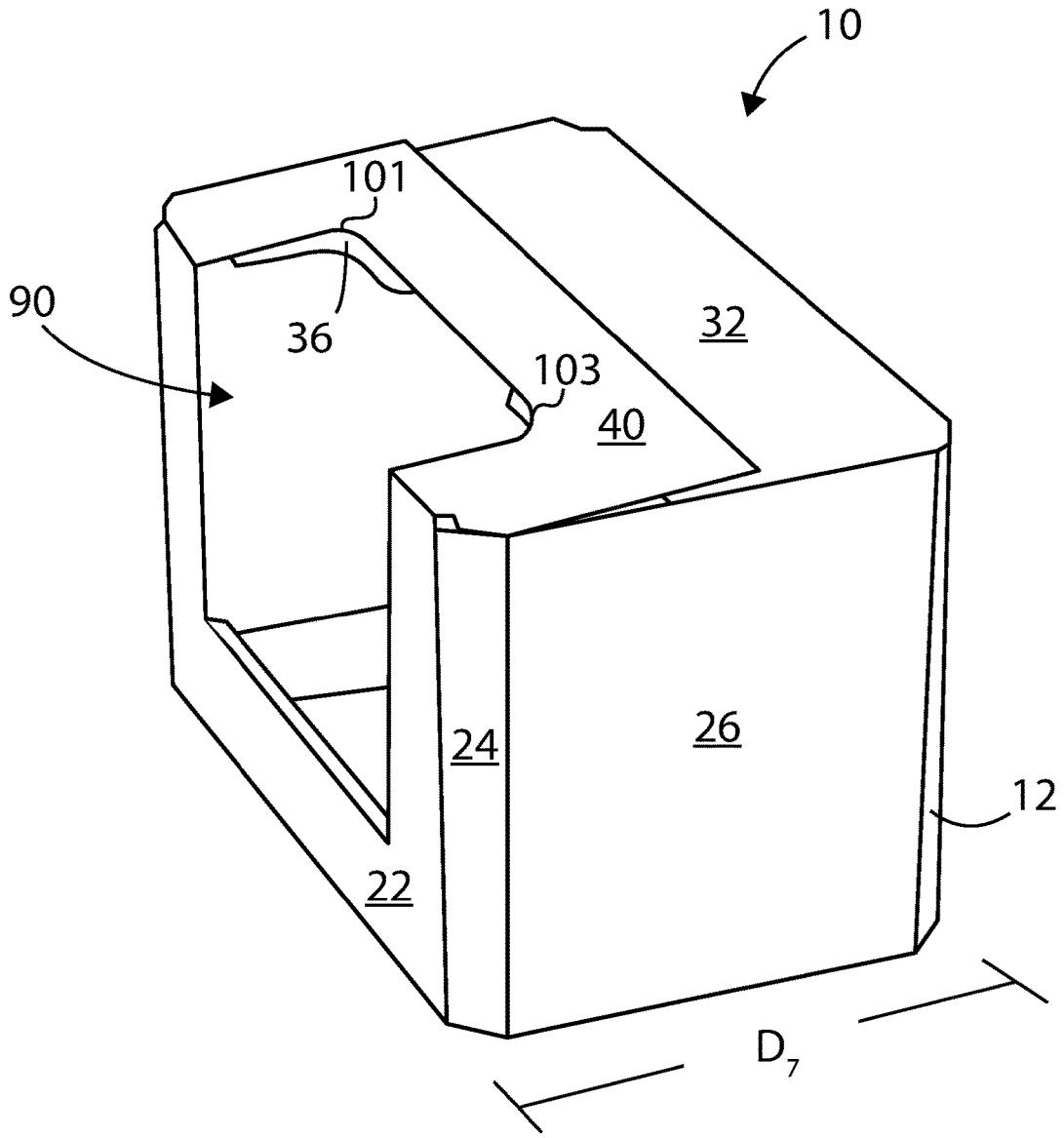
FIG. 2 is a perspective view of a carton formed from the blank shown in FIG. 1.

Turning now to the Figures, FIG. 1 is a top plan view of an exemplary blank 10 of sheet material for forming the carton 100 shown in FIG. 2. Blank 10 defines a leading edge 6 and an opposing trailing edge 8. In one embodiment, blank 10 includes, from leading edge 6 to trailing edge 8, a first corner panel 12, a rear panel 14, a second corner panel 16, a first side panel 18, a third corner panel 20, a front panel 22, a fourth corner panel 24, a second side panel 26, and a glue flap 28 coupled together along preformed, generally parallel, fold lines 11, 13, 15, 17, 19, 21, 23, 25, respectively. In the exemplary embodiment, corner panels 12, 16, 20, 24 are each substantially congruent; however, it should be understood that corner panels 12, 16, 20, and/or 24 can each have any suitable size, shape, and/or configuration that enables blank 10 and/or carton 100 to function as described herein.

First corner panel 12 extends from rear panel 14 along fold line 11 to leading edge 6, second corner panel 16 extends from rear panel 14 along fold line 13, first side panel 18 extends from second corner panel 14 along fold line 15, third corner panel 20 extends from first side panel 16 along fold line 17, front panel 22 extends from third corner panel 20 along fold line 19, fourth corner panel 24 extends from front panel 22 along fold line 21, second side panel 26 extends from fourth corner panel 24 along fold line 23, glue flap 28 extends from second side panel 26 along fold line 25. Fold lines 11, 13, 15, 17, 19, 21, 23, and/or 25, as well as other fold lines and/or hinge lines described herein, may include any suitable line of weakening and/or line of separation known to those skilled in the art and guided by the teachings herein provided.

Rear panel 14 includes a first bottom major flap 30 and a first top major flap 32 extending therefrom along respective fold lines 27 and 29. In the illustrated embodiment, first bottom major flap 30 has a depth D4 (measured between fold line 27 and outer free edge 109 of first bottom major flap 30) that is less than about half of a depth D7 (shown in FIG. 2) of carton 100. Depth D4 may be substantially less than about half of depth D7 and may be, for example, about one-fourth of depth D7. In the illustrated embodiment, first top major flap 32 has a depth D3 (measured between fold line 29 and outer free edge 115 of first top major flap 32) that is greater than half of the depth D7 of carton 100.

First bottom major flap 30 and first top major flap 32 each have a width W2 that is greater than a width W1 of rear panel 14. First bottom major flap 30 has angled corner edges 70, 71 that extend outwardly from points generally adjacent to fold line 27 on respective sides of first bottom major flap 30. In the constructed carton 100, angled corner edge 70 is positioned in an abutting, edge-to-face relationship with an interior surface of first corner panel 12 (or alternatively, with an interior surface of glue flap 28). Angled corner edge 71 is positioned in an abutting, edge-to-face relationship with an interior surface of second corner panel 16. First top major flap 32 has angled corner edges 72, 74 that extend outwardly from points generally adjacent fold line 29 on respective sides of first top major flap 32. In the constructed carton 100, angled corner edge 72 is positioned in an abutting, edge-to-face relationship with an interior surface of first corner panel 12 (or alternatively, with an interior surface of glue flap 28). Angled corner edge 74 is positioned in an abutting, edge-to-face relationship with an interior surface of second corner panel 16.

First side panel 18 has a first bottom minor flap 34 and a first top minor flap 36 extending therefrom along respective fold lines 31 and 33. First top minor flap 36 has a generally rectangular corner notch 56 struck from a front-side portion of its free outer edge.

Front panel 22 has a second bottom major flap 38 and a second top major flap 40 extending therefrom along respective fold lines 35 and 37. In the illustrated embodiment, second bottom major flap 38 has a depth D5 (measured between fold line 35 and outer free edge 111 of second bottom major flap 38) that is less than about half of the depth D7 of carton 100. Depth D5 may be substantially less than about half of depth D7 and may be, for example, about one-fourth of depth D7. Depth D5 may be equal to depth D4 of first bottom major flap 30. First and second bottom major flaps 30, 38 may be substantially congruent. Second bottom minor flap 38 includes apertures 60, 62 that are disposed adjacent to fold line 35. Apertures 60, 62 are sized and positioned so as to receive respective tabs 64, 66 when the carton 100 is constructed as will be described in more detail below.

Second bottom major flap 38 and second top major flap 40 each have a width W4 that is greater than a width W3 of front panel 22. Second bottom major flap 38 has angled corner edges 75, 76 that extend outwardly from points generally adjacent to fold line 35 on respective sides of second bottom major flap 38. In the constructed carton 100, angled corner edge 75 is positioned in an abutting, edge-to-face relationship with an interior surface of third corner panel 20. Angled corner edge 76 is positioned in an abutting, edge-to-face relationship with an interior surface of fourth corner panel 24. Second top major flap 40 has angled corner edges 77, 78 that extend outwardly from points generally adjacent fold line 37 on respective sides of second top major flap 40. In the constructed carton 100, angled corner edge 77 is positioned in an abutting, edge-to-face relationship with an interior surface of third corner panel 20. Angled corner edge 78 is positioned in an abutting, edge-to-face relationship with an interior surface of fourth corner panel 24

Blank 10 includes a window panel 68 that is struck primarily from front panel 22 but that also extends into second top major flap 40 a distance D1, thereby interrupting fold line 37. In the illustrated embodiment, window panel 68 is generally rectangular in shape. Window panel 68 is hinged at its lower edge to front panel 22 along a fold line 47. The top and first and second side edges of window panel 68 are defined by respective cut or tear lines 49, 98, and 99. Window panel 68 includes a first bridge panel 54 that extends between fold line 47 and fold line 43. First bridge panel 54 has a height (measured between fold lines 47 and 43) that is preferably about equal to a thickness of the blank 10. A second bridge panel 52 is hingedly connected to first bridge panel 54 along fold line 43. Second bridge panel 52 has a height H2 (measured between fold lines 43 and 45) that is preferably about equal to a distance D8 between fold line 35 and fold line 47. A floor panel 50 is hingedly connected to second bridge panel 52 along fold line 45. First and second tabs 64, 66 interrupt fold line 45 and extend upwards therefrom.

Referring to FIG. 2, the constructed carton 100 forms a generally rectangular box with mitered corners. Carton 100 includes a product display window 90 that extends through a portion of the carton's front and top walls. Window panel 68 is configured to fold inwardly into an interior of the carton 100 so as to form the product display window 90. A portion of window panel 68, namely floor panel 50, is configured to form a portion of the bottom wall of carton 100. First and second bridge panels 54, 52 facilitate the proper positioning of floor panel 50 in the constructed carton 100 and help fix it in place.

Figure 3:
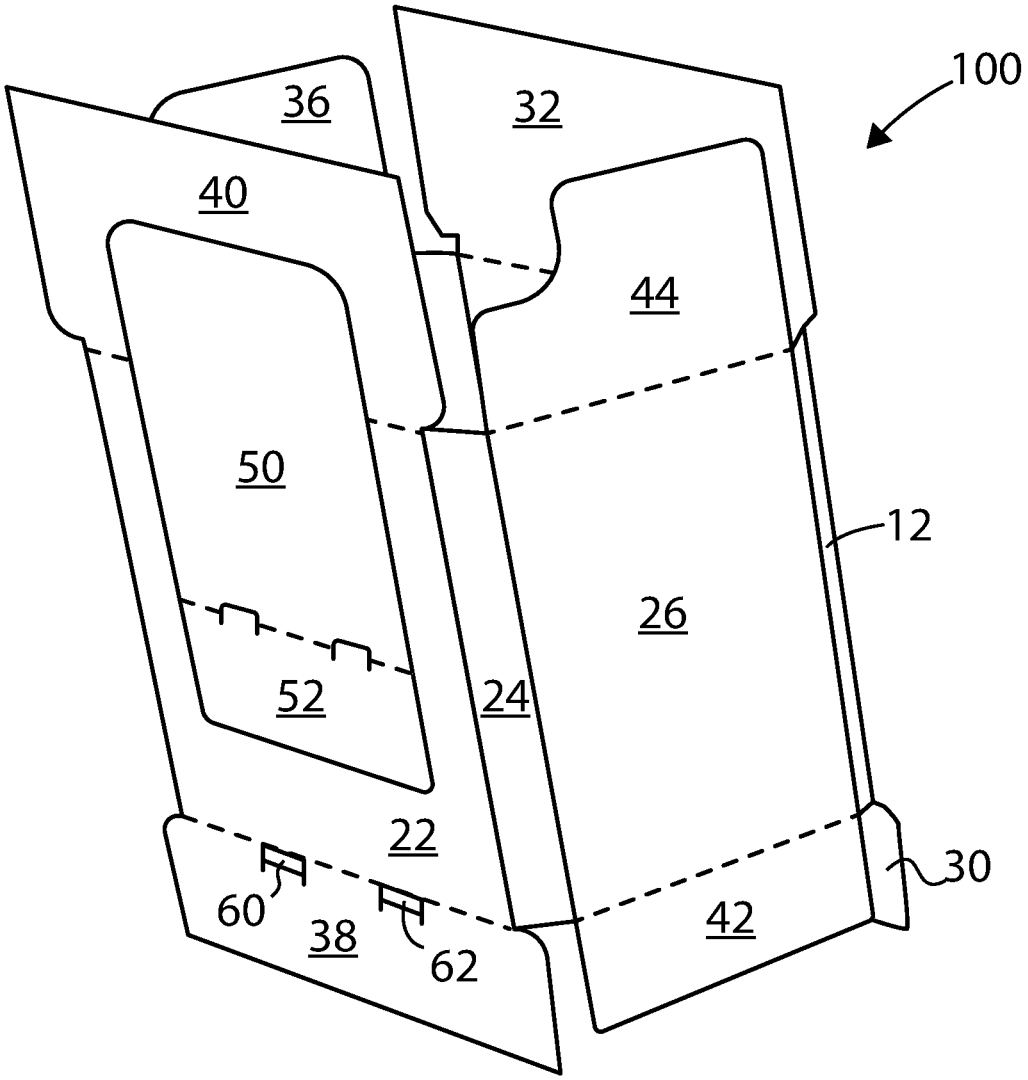
FIGS. 3-8 are perspective views showing various steps in the construction of the carton of FIG. 2.

FIGS. 3-8 depict views of carton 100 in various stages of formation. FIG. 3 is a side perspective view of a partially-formed carton 100 in which the glue flap panel 28 has been joined to first corner panel 12 to form a generally tubular structure. In the illustrated embodiment, exterior surface of glue flap panel 28 is adhered to interior surface of first corner panel 12. Alternatively, the interior surface of glue flap panel 28 can be adhered to the exterior surface of first corner panel 12. Further, although adhesive is described herein, glue flap panel 28 can be coupled to first corner panel 12 using any suitable fastener and/or technique. As illustrated, the partially-formed carton 100 in FIG. 3 is shown in an open configuration. However, the partially-formed carton 100 may be shipped in a collapsed/knocked-down flat configuration before being transitioned into the open configuration shown in FIG. 3.

Figure 4:
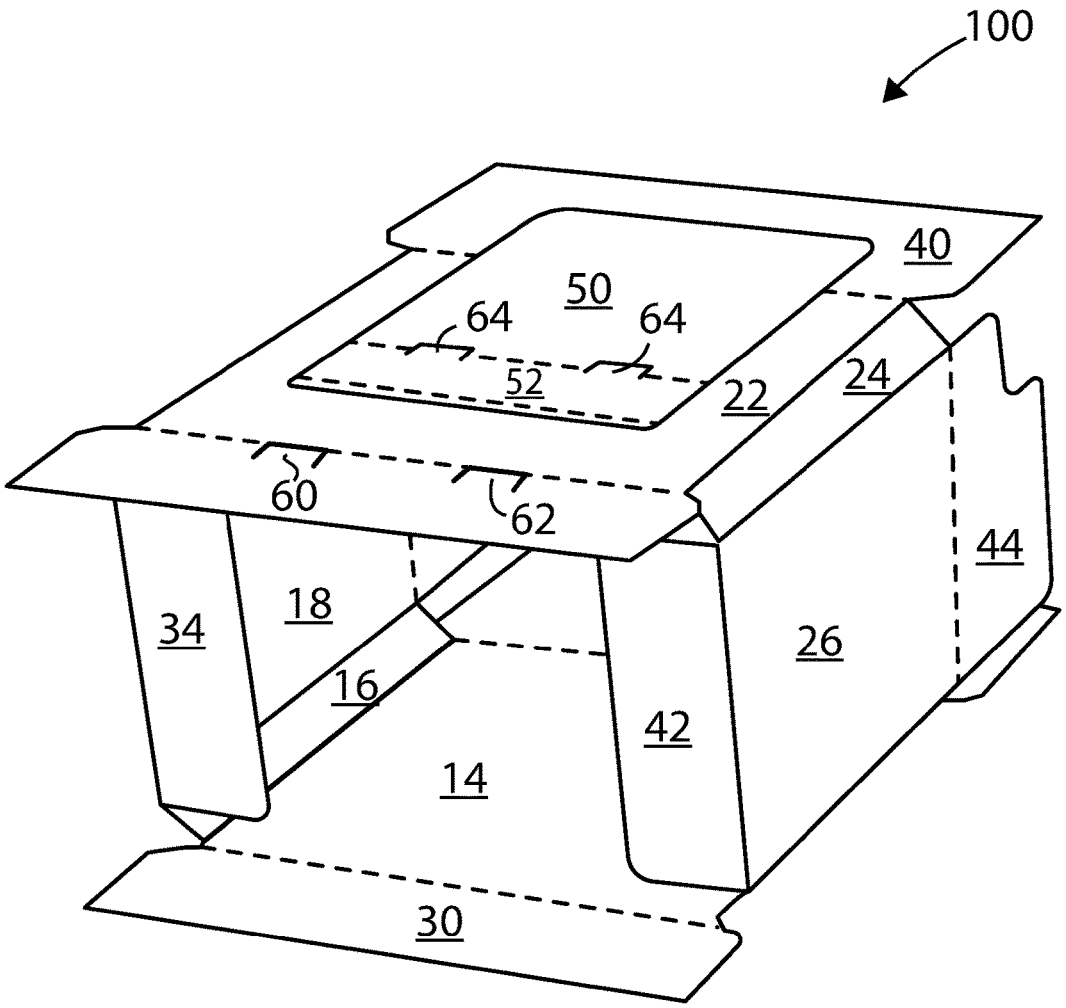
Figure 5:
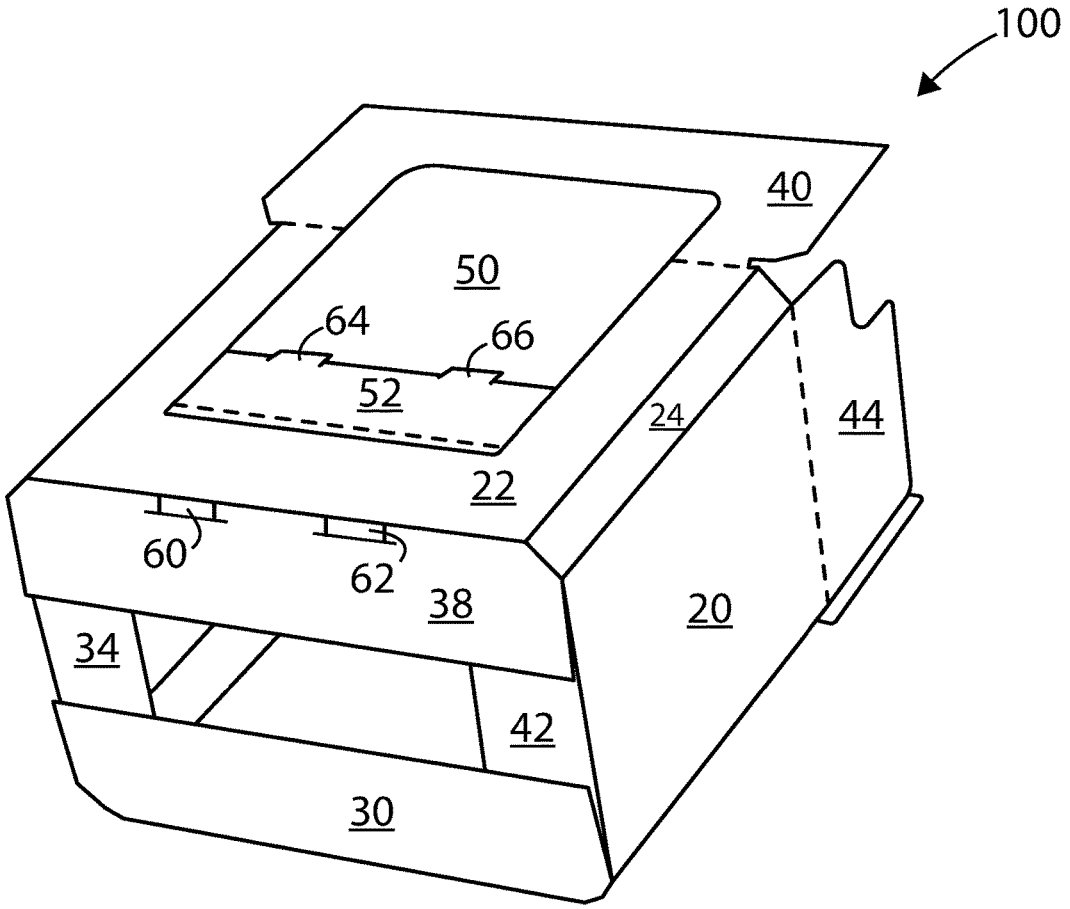

Referring to FIG. 4, first bottom minor flap 34 and second bottom minor flap 42 are folded inwardly about respective fold lines 31 and 39 until they are substantially perpendicular to respective first and second side panels 18, 26. Referring to FIG. 5, glue or other adhesive treatment can be applied to the interior surface portions of first and second bottom major flaps 30, 38 that are configured to overlap first and second bottom minor flaps 34, 42, or alternatively, to corresponding portions of the outer surfaces of first and second bottom minor flaps 34, 42. First and second bottom major flaps 30, 38 are folded inwardly about respective fold lines 27, 35 until they are brought into contact with first and second bottom minor flaps 34, 42 and secured thereto.

Figure 6:
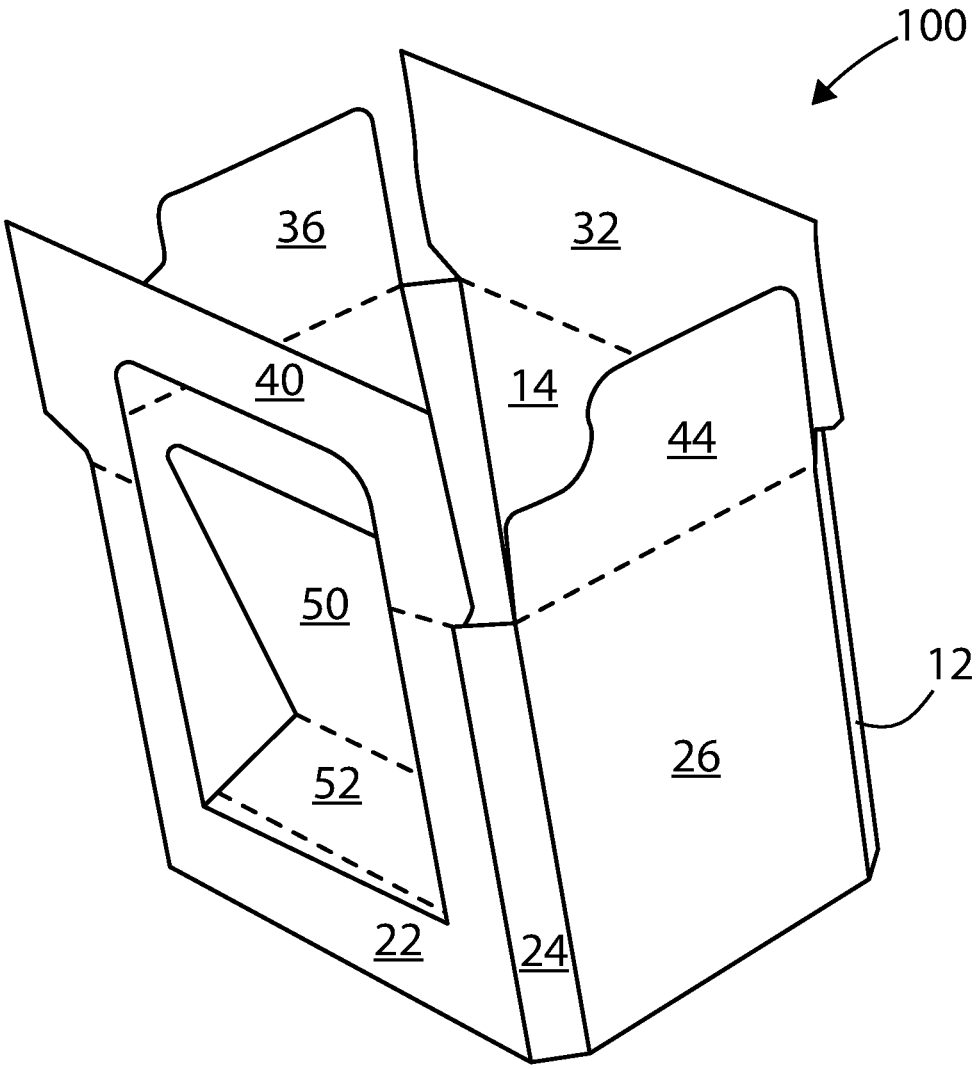
Figure 7:
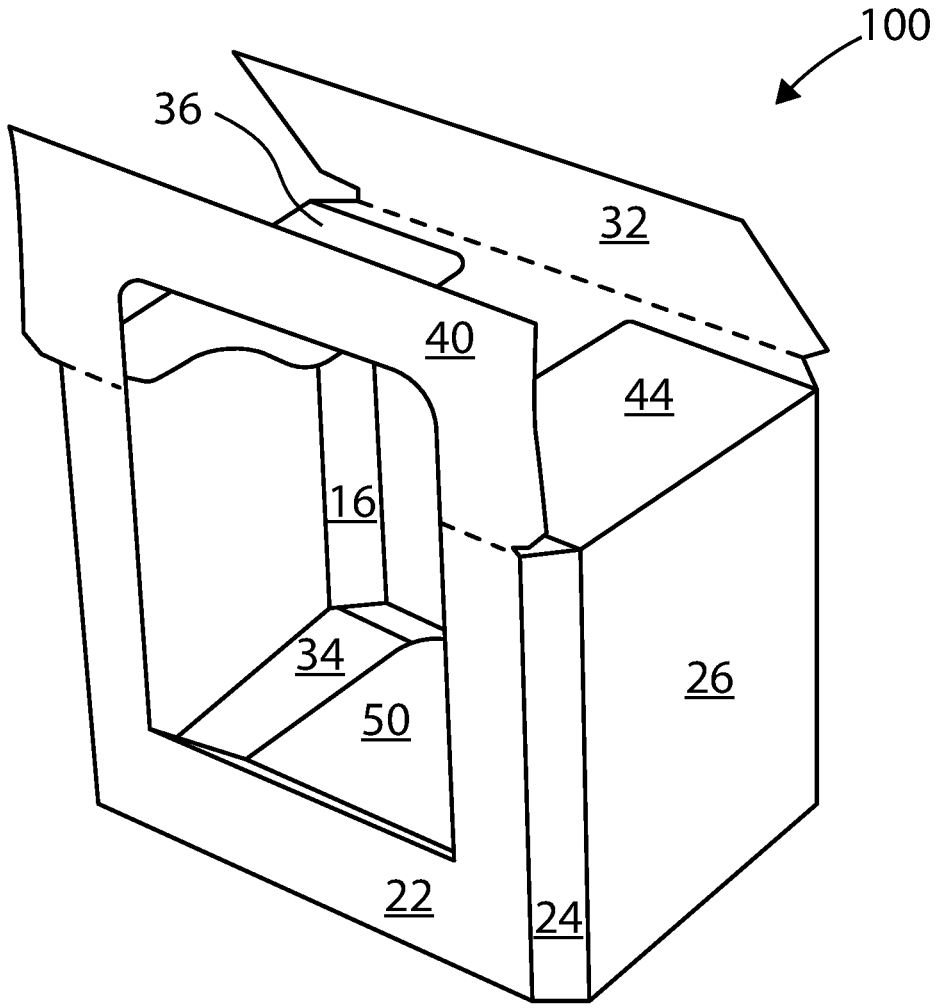

Referring to FIGS. 6 and 7, window panel 68 is folded inwardly about fold line 47, separating the window panel 68 from front panel 22 and second top major panel 40 along cut or tear lines 49, 98, 99. First bridge panel 54 is folded inwardly about fold line 47 until it is substantially perpendicular to front panel 22. Second bridge panel 52 is folded inwardly about fold line 43 until its inner surface is brought into face-contacting relationship with an inner surface of the corresponding lowermost portion of front panel 22. Tabs 64, 66 of second bridge panel 52 are received within respective apertures 60, 62, thereby helping to fix the second bridge panel 52 (and ultimately, floor panel 50) in place. Simultaneously, floor panel 50 is folded outwardly about fold line 45 until it is substantially perpendicular to front panel 22 and positioned so that portions of its outer surface are in a face-contacting relationship with overlapping portions of the interior surfaces of first and second bottom minor flaps 34, 42. In certain embodiment, glue or other adhesive treatment can be used to secure second bridge panel 52 to the corresponding lowermost portion of front panel 22 and/or to secure floor panel 50 to overlapping portions of first and second bottom minor flaps 34, 42.

Figure 8:
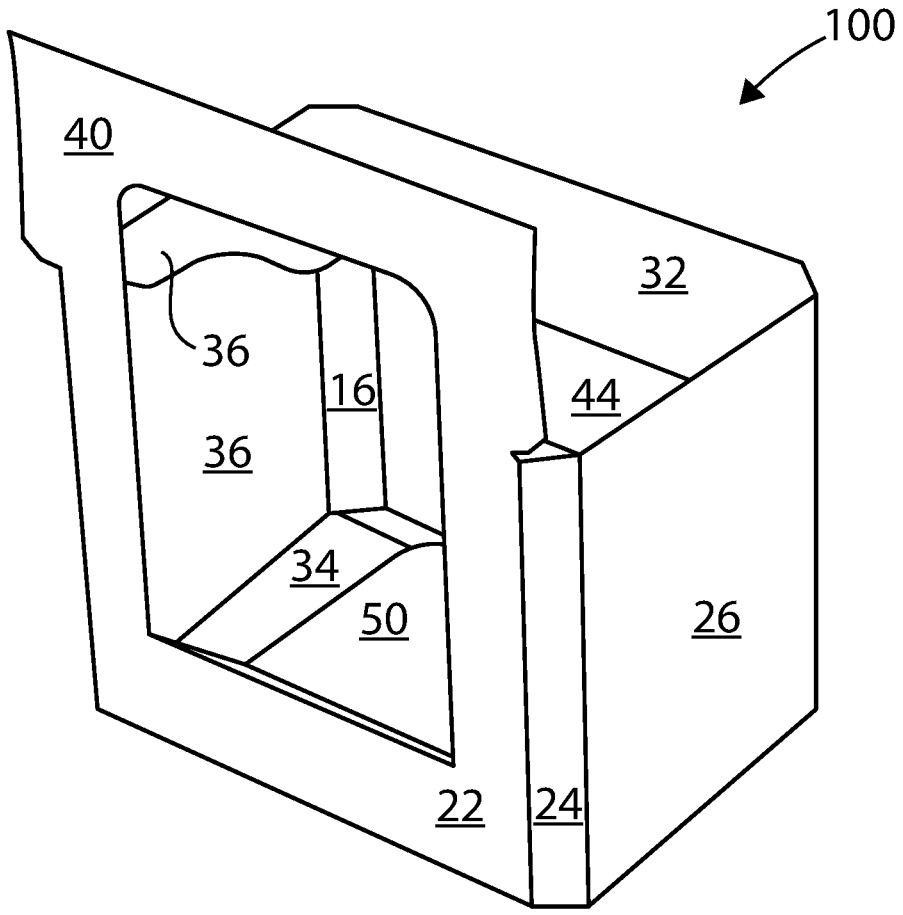

Referring to FIG. 7, first and second top minor flaps 36, 44 are folded inwardly about respective fold lines 33, 41 until they are substantially perpendicular to first and second side panels 18, 26. Referring to FIG. 8, glue or other adhesive treatment can be applied to interior surface portions of first top major flap 32 that are configured to overlap first and second top minor flaps 36, 44, or alternatively, to corresponding portions of the outer surfaces of first and second top minor flaps 36, 44. First top major flap 32 is folded inwardly about fold line 29 until it is brought into contact with first and second top minor flaps 36, 44 and secured thereto. In an alternative embodiment, the order in which minor flaps 36, 44 and first top major flap 32 are folded may be altered so as to sandwich first top major flap 32 between first and second top minor flaps 36, 44.

Referring to FIG. 8, glue or other adhesive treatment can be applied to an interior surface of second top major flap 40, or alternatively, to corresponding portions of the outer surfaces of first top major flap 32 and first and second top minor flaps 36, 44. Second top major flap 40 is folded inwardly about fold line 37 until it is brought into contact with first top major flap 32 and first and second top minor flaps 36, 44 and secured thereto. This results in the completed carton 100 as shown in FIG. 2. In the constructed carton 100, first and second corner portions 101, 103 of second top major flap 40 defined by display window 90 are configured to substantially align with and overlap respective notches 56, 58 of first and second minor flaps 36, 44.

Figure 9:
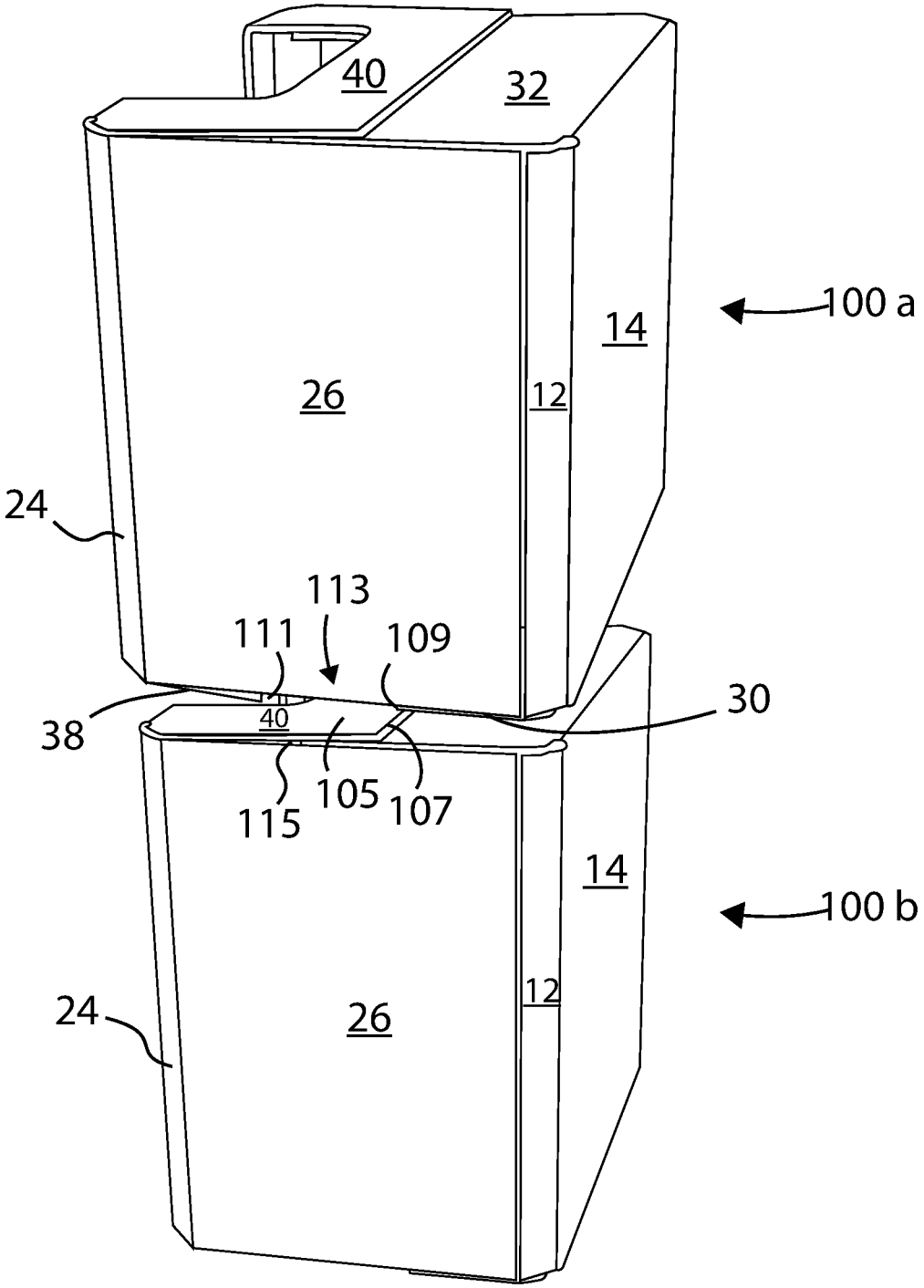
FIG. 9 is a perspective view showing two cartons of the type depicted in FIG. 2 being stacked one on top of the other.

As illustrated, first and second top major flaps 32, 40 are sized and configured such that second top major flap 40 partially overlaps first top major flap 32 in the constructed carton 100. This overlap creates a bulging or outwardly-projecting overlapping portion 105 defined generally between the outer free edge 115 of first top major flap 32 and the outer free edge 107 of second top major flap 40. As shown in FIG. 9, this configuration can provide a "passive centering" benefit when stacking multiple cartons. In particular, the overlapping portion 105 of a first carton 100*b* is configured to be at least partially received within a bottom wall recess 113 of a second carton 100*a* when the second carton 100*a* is stacked on top of the first carton 100*b*. Recess 113 is defined between the outer free edge 109 of first bottom major flap 30 and the outer free edge 111 of second bottom major flap 38. In particular, the outer edge 109 of the first bottom major flap 30 of top carton 100*a* may be configured to abut the outer edge 107 of the second top major flap 40 of lower carton 100*b* when the two cartons 100*a*, 100*b* are stacked. This mating arrangement between overlapping portion 105 and recess 113 may provide tactile feedback to a user stacking the cartons 100*a*, 100*b* indicating that the two cartons 100*a*, 100*b* are generally centered on one another. Moreover, this arrangement may also contribute to the stability of the stacked cartons by making it more difficult for top carton 100*a* to move relative to bottom carton 100*b*.

The configuration of carton 100 in which second top major flap 40 partially overlaps first top major flap 32, thereby allowing second top major flap 40 to be secured directly to first major flap 32 as well as to first and second minor flaps 36, 44 may advantageously provide carton 100 with enhanced stacking and/or lateral strength. The stacking and/or lateral strength of carton 100 may also be advantageously enhanced by the use of corner panels 12, 16, 20, 24 that are configured to engage angled edges of the top and bottom major flaps.

The use of window panel 68 to form a portion of the bottom wall of carton 100 may advantageously reduce the amount of blank material waste as well as the amount of blank material needed to form blank 10 and the overall size or "footprint" of blank 10. In particular, this configuration may reduce the required dimensions of the bottom major and minor flaps 30, 34, 38, 42.

Exemplary embodiments of blanks and methods for forming cartons are described above in detail. The apparatus and methods are not limited to the specific embodiments described herein, but rather, components of apparatus and/or steps of the methods may be utilized independently and separately from other components and/or steps described herein. For example, the methods may also be used in combination with other cartons and methods, and are not limited to practice with only the cartons and methods as described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A carton comprising:

a top wall, a bottom wall, and a front wall;

wherein a display window is formed through at least a portion of said front wall and through at least a portion of said top wall, wherein said display window is formed by an inwardly-folding window panel, said inwardly-folding window panel forming at least a portion of said bottom wall;

wherein said top wall comprises oppositely-disposed first and second top major flaps that partially overlap to form an outwardly-projecting overlapping portion of said top wall;

wherein said bottom wall comprises oppositely-disposed first and second bottom major flaps that define a recess therebetween;

wherein said overlapping portion of a first such carton is configured to be received within said recess of a second such carton when said second such carton is stacked on top of said first such carton.

2. The carton according to claim 1, wherein said overlapping portion and said recess are operably configured such that said second such carton is substantially centered with respect to said first such carton when said overlapping portion of said first such carton is received within said recess of said second such carton.

3. The carton according to claim 1, wherein said carton further comprises a rear wall, first and second side walls, and first, second, third, and fourth corner walls.

4. The carton according to claim 3, wherein said first and second top major flaps and said first and second bottom major flaps each comprise first and second angled edges, each of said first and second angled edges abutting an interior surface of an adjoining one of said first, second, third, or fourth corner walls.

5. The carton according to claim 1, wherein said top wall further comprises first and second minor top flaps, said first top minor flap defining a first corner notch and said second top minor flap defining a second corner notch, wherein said second top major flap comprises first and second corner portions defined by an edge of said display window, and wherein said first corner portion is substantially aligned with and overlaps said first corner notch and said second corner portion is substantially aligned with and overlaps said second corner notch.

6. The carton according to claim 1, wherein said inwardly-folding window panel comprises a first bridge panel hingedly connected along a lower edge of said first bridge panel to said front wall, a second bridge panel hingedly connected to said first bridge panel, and a floor panel hingedly connected to said second bridge panel, said floor panel forming said at least portion of said bottom wall.

7. The carton according to claim 6, wherein said second bridge panel comprises at least one tab, wherein said second bottom major flap defines at least one aperture, and wherein said at least one tab is received within said at least one aperture.

8. A blank for forming a carton, the blank comprising:

a front panel configured to form a front wall in a set-up carton;

first and second side wall panels configured to form respective first and second side walls in the set-up carton;

a rear panel configured to form a rear wall in the set-up carton;

oppositely-disposed first and second top major flaps configured to form at least part of a top wall in the set-up carton, said second top major flap being hingedly connected to said front panel along a first fold line;

a generally-rectangular window panel struck from a portion of said front panel and a portion of said second top major flap so as to interrupt said first fold line, said window panel comprising a floor panel configured to form at least a portion of a bottom wall in the set-up carton, said window panel being hingedly connected to a lower portion of said front panel along a second fold line, said window panel being folded into an interior of the set-up carton to form a display window extending through at least a portion of said front wall and through at least a portion of said top wall;

wherein said first and second top major flaps are configured to overlap in the set-up carton to form an outwardly-projecting overlapping portion of said top wall;

wherein said bottom wall comprises oppositely-disposed first and second bottom major flaps that define a recess therebetween;

wherein said overlapping portion of a first such set-up carton is configured to be received within said recess of a second such set-up carton when said second such set-up carton is stacked on top of said first such set-up carton.

9. The blank according to claim 8, wherein said overlapping portion and said recess are operably configured such that said second such set-up carton is configured to be substantially centered with respect to said first such set-up carton when said overlapping portion of said first such set-up carton is received within said recess of said second such set-up carton.

10. The blank according to claim 8, wherein said blank further comprises first, second, third, and fourth corner panels configured to form respective first, second, third, and fourth corner walls in the set-up carton.

11. The blank according to claim 10, wherein said first and second top major flaps and said first and second bottom major flaps each comprise first and second angled edges, each of said first and second angled edges being configured to abut an interior surface of an adjoining one of said first, second, third, or fourth corner walls in the set-up carton.

12. The blank according to claim 8, wherein said blank further comprises first and second minor top flaps, said first top minor flap defining a first corner notch and said second top minor flap defining a second corner notch, wherein said second top major flap comprises first and second corner portions defined by an edge of said display window in the set-up carton, and wherein said first corner portion is substantially aligned with and overlaps said first corner notch and said second corner portion is substantially aligned with and overlaps said second corner notch in the set-up carton.

13. The blank according to claim 8, wherein said window panel comprises a first bridge panel hingedly connected to said lower portion of said front panel along said second fold line, a second bridge panel hingedly connected to said first bridge panel, and a floor panel hingedly connected to said second bridge panel, said floor panel forming said at least portion of said bottom wall in the set-up carton.

14. The blank according to claim 13, wherein said second bridge panel comprises at least one tab, wherein said second bottom major flap defines at least one aperture, and wherein said at least one tab is configured to be received within said at least one aperture in the set-up carton.

* * * * *